United States Patent [19]

Haley

[11] 4,095,312

[45] Jun. 20, 1978

[54] APPARATUS FOR MAKING A NONWOVEN FABRIC

[75] Inventor: David J. Haley, Durham, N.C.

[73] Assignee: Monsanto Company, St. Louis, Mo.

[21] Appl. No.: 740,575

[22] Filed: Nov. 10, 1976

Related U.S. Application Data

[62] Division of Ser. No. 636,267, Nov. 28, 1975.

[51] Int. Cl.[2] ..... D01G 25/00; D04H 3/05

[52] U.S. Cl. ..... 19/308; 28/101; 28/103; 28/257; 156/181; 156/439; 156/441; 156/555; 264/210 F; 425/72 S

[58] Field of Search ..... 156/167, 177, 181, 296, 156/555, 500, 441, 439; 264/176 F, 212, 10 F; 28/1 CL, 15 M, 72 NW, 72.12; 425/72 R, 83; 19/155, 156.3, 156.4, 161 R

[56] References Cited

U.S. PATENT DOCUMENTS

| | | | |
|---|---|---|---|
| 2,693,844 | 11/1954 | Bay | 28/15 M |
| 2,875,503 | 3/1959 | Frickert et al. | 156/181 |
| 3,010,865 | 11/1961 | Porter | 264/212 |
| 3,853,651 | 12/1974 | Porte | 156/181 |

FOREIGN PATENT DOCUMENTS

| | | | |
|---|---|---|---|
| 159,324 | 8/1953 | Australia | 28/257 |

*Primary Examiner*—David Klein
*Assistant Examiner*—Michael W. Ball
*Attorney, Agent, or Firm*—Donald J. Fitzpatrick

[57] ABSTRACT

Method and apparatus for making a nonwoven fabric wherein a first group of filaments are projected in a longitudinal direction into the nip of a pair of nipped and moving collecting surfaces in such a manner that the filaments fold into and are captured and held by the nip with spans of the filaments lying in the plane of the nip and at the same time projecting a second group of filaments in a longitudinal direction toward one of the collecting surfaces at a location spaced from the nip. The second group of filaments impinges on an impact plate positioned above the collecting surface and is pulled off the impact plate by the moving collecting surface, this causing the filaments in the second group to extend primarily in the machine direction. The moving collecting surfaces carry the groups of filaments into contact with each other to form a nonwoven fabric which is subsequently bonded in a conventional manner to form a finished fabric. In the finished fabric the filaments from the first group will for the most part extend across the fabric while the filaments from the second group will for the most part extend along the fabric to give a fabric having a stretch on the bias.

5 Claims, 5 Drawing Figures

APPARATUS FOR MAKING A NONWOVEN FABRIC

This is a division of application Ser. No. 636,267, filed Nov. 28, 1975.

BACKGROUND OF THE INVENTION a. Field of the Invention

This invention relates to methods and apparatus for forming nonwoven fabrics.

b. Description of the Prior Art

It is known to make spunbonded fabrics by spinning filaments and using an air nozzle to attenuate and drive the filaments onto a moving collection surface to form a fabric which is subsequently bonded to secure the filaments in the fabric to each other. In the finished fabric the filaments will extend in all directions in the fabric to give the fabric a substantially uniform strength in every direction. While this fabric has good strength characteristics, it will not stretch in any direction. This is a disadvantage in some end uses where it is desirable to have a fabric which will stretch at least to some extent.

SUMMARY OF THE INVENTION

This invention provides a process and apparatus for making a fabric which has good strength characteristics and which can be stretched in two directions, wherein a first group of continuous filaments are projected in a longitudinal direction into the nip of a pair of nipped and moving collecting surfaces in such a manner that the filaments fold into and are captured and held by the nip with spans of the filaments lying in the plane of the nip and at the same time projecting a second group of filaments in a longitudinal direction toward one of the collecting surfaces at a location spaced from the nip. The second group of filaments impinges on a plate positioned above the collecting surfaces and is pulled off the plate by the moving collecting surface, this causing the filaments in the second group to extend primarily in the machine direction. The collecting surfaces bring the filaments from the two groups together to form a fabric which is subsequently bonded in a conventional manner to form a finished fabric. In the finished fabric the filaments from the first group will lie in positions predominantly transverse to the fabric while the filaments from the second group will extend more or less longitudinally along the fabric to give a fabric which will stretch in two directions.

DETAILED DESCRIPTION OF THE INVENTION

Figure 1:
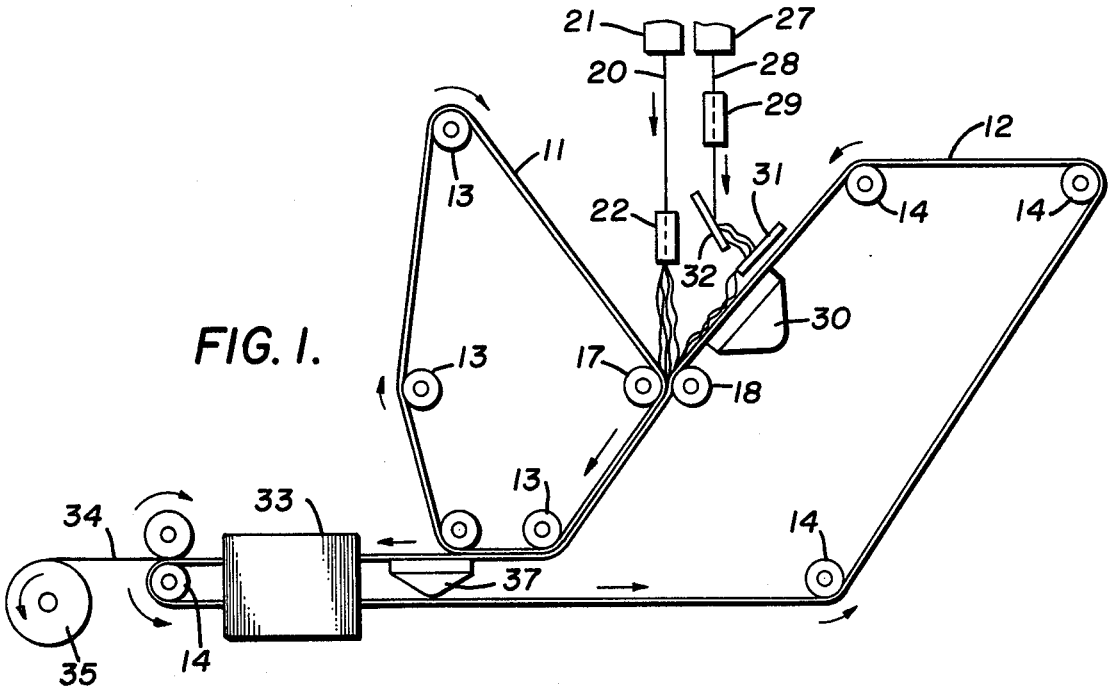
FIG. 1 is a schematic view of the apparatus showing the manner in which the two groups of filaments are fed onto collecting surfaces.

Referring now in detail to the drawings there is shown in FIG. 1 a pair of porous belts 11 and 12 mounted on rolls 13 and 14, respectively, which are driven to carry the belts in the directions shown. The belts 11 and 12 also pass over rolls 17 and 18 which are driven in a convenient manner. The rolls 17 and 18 are so positioned that the belts 11 and 12 form a nip as they pass over these rolls.

Filaments 20 formed by a first spinnerette 21 are attenuated by an attenuator or air nozzle 22 and are projected longitudinally into the nip formed by the porous belts 11 and 12. The terms "nip" and "nipped" mean that the belts 11 and 12 passing over the rolls 17 and 18 are in contact with each other or are positioned in such close proximity that the stream of air from the nozzle 22 cannot impel the filaments 20 between the belts 11 and 12. Instead, the belts 11 and 12 capture and hold the filaments 20 in the plane of the nip.

Figure 3:
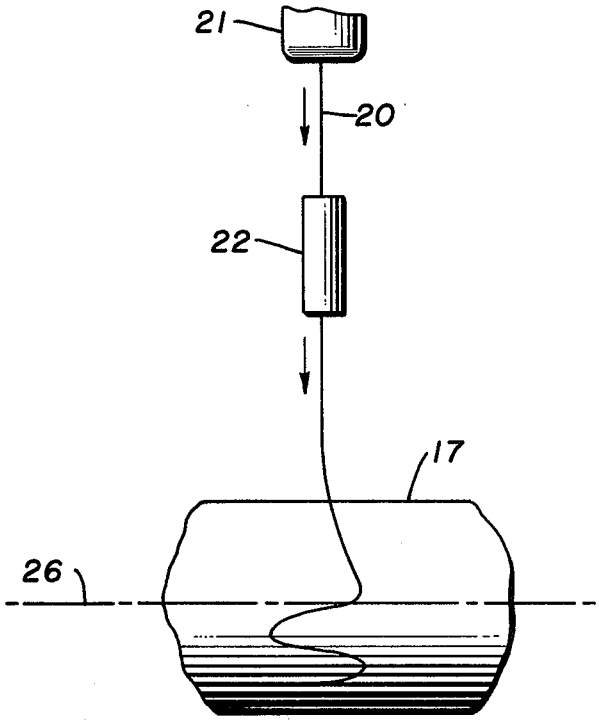
FIG. 3 is a fragmentary perspective view showing the manner in which a single filament from the first group of filaments is fed into and captured by the nip of the two collecting surfaces.
Figure 4:
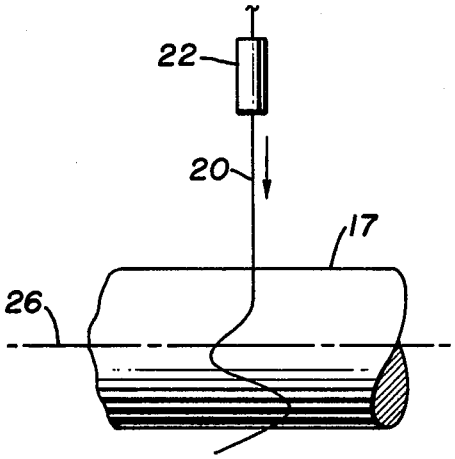
FIG. 4 is a fragmentary perspective view showing the manner in which a single filament from the first group is fed into the nip of the collecting surfaces when a slower filament projecting speed, relative to collecting surface speed, is used.

FIG. 3 illustrates the manner in which the filaments 20 are projected into the nip of the belts 11 and 12. In this figure the belts are omitted to show one of the rolls 17 or 18 which hold the belts in nipped configuration and illustrate the manner in which a single filament is folded into this nip. It should be understood that each of the attenuators 22 will forward a number of individual filaments and that there will be a number of attenuators 22 side by side to provide a uniform lay-down of filaments along the length of the roll. By adjusting the speed of the belts relative to the filament speed the filaments 20 can be fed into the nip in a manner such that spans of the filaments will lie almost parallel to the nip as illustrated in FIG. 3, the reference numeral 26 identifying a line lying along the nip of the roll. An increase in belt speed, relative to filament speed, will result in a lay-down pattern such as that illustrated in FIG. 4.

A second spinnerette 27 forms filaments 28 which are attenuated and forwarded by an air nozzle or attenuator 29 onto a stationary deflector plate 32 positioned near the belt 12. The filaments 28 are deflected off the deflector onto a plate or impact surface 31 positioned adjacent to the belt 12 and are pulled off the plate 31 onto the belt 12 where they are held in place by a suction box 30 (FIG. 1) positioned behind the belt 12. The action of the moving belt in pulling the filaments 28 off the plate 31 insures that these filaments are positioned primarily parallel to the direction of travel of the belt 12. The deflector 32 serves to separate the filaments 28 from each other and to direct air flow from the nozzle 29 away from the nip of the belts.

The belt 12 carries the deposited filaments 28 into contact with the filaments 20 being deposited in the nip of the belts 11 and 12 to form a nonwoven fabric. The fabric is held together by the belts 11 and 12 and is then carried through a bonding zone 33 to bond the filaments in the fabric together to form a finished fabric 34 which is taken up on a takeup roll 35, a suction box 37 being used to maintain the fabric on the belt 12 at the point where the belts 11 and 12 separate. Various methods are conventionally used for bonding nonwoven fabrics and one skilled in the art can readily choose a bonding process which is compatible to the filaments which make up the fabric.

Figure 5:
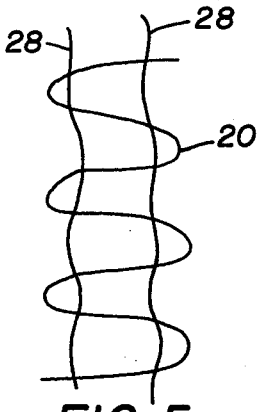
FIG. 5 is a diagrammatic view showing the manner in which filaments from the second group overlap filaments from the first group in the finished fabric.

FIG. 5 is a diagrammatic view showing the manner in which the filaments 28 overlap the filaments 20 in the finished fabric, this view showing one of the filaments 20 and two of the filaments 28. It can readily be seen that the filaments 28 extend primarily in the machine direction while the filaments 20 extend primarily in a direction transverse to the machine direction. This fabric will, after being bonded, have uniform strength in the machine and transverse directions and will stretch on the bias.

Figure 2:
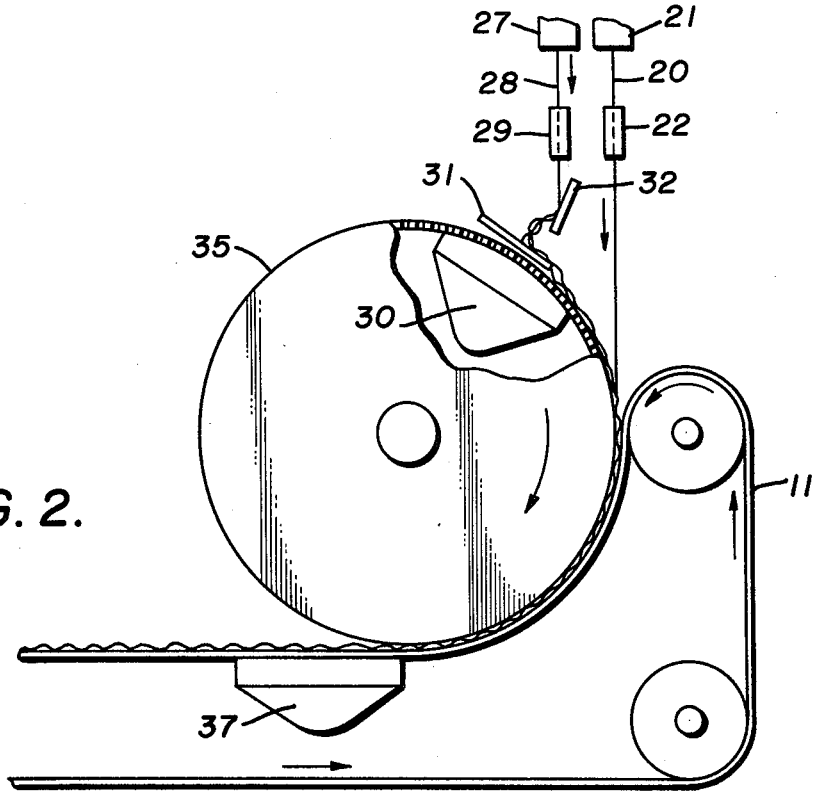
FIG. 2 is a schematic view of another embodiment of the invention.

FIG. 2 is a diagrammatic view of another embodiment of the apparatus. In this apparatus a perforated drum 35 is substituted for the belt 11, with the filaments 20 being projected into the nip formed by the drum 35 and the belt 11. The filaments 28 are deflected off the deflector 32 onto the plate 31, which is positioned adjacent to the roll 35. The rotating roll 35 pulls the filaments 28 off the plate 31 and, in doing so, causes these filaments to extend primarily in the direction of movement of the roll 35.

The roll 35 carries the filaments 28 into contact with the filaments 20 to form a nonwoven fabric. This fabric is subsequently bonded in a convenient manner to form a fabric having a two-way stretch.

What is claimed is:

1. An apparatus for forming a nonwoven fabric having uniform stretch in two directions, comprising:

a. a pair of moving collecting surfaces positioned to form a nip;

b. a first air nozzle positioned to direct a first group of filaments in a longitudinal direction into said nip so that said filaments fold into and are captured and held by said nip with spans of said filaments lying in the plane of said nip, thereby causing said filaments to lie in positions predominately transverse to said fabric;

c. an element having an impact surface positioned adjacent to one of the collecting surfaces at a location spaced from said nip;

d. a second air nozzle positioned to direct a second group of filaments in a longitudinal direction onto said impact surface; and e. said impact surface being positioned in such a manner that said second group of filaments can be pulled off said impact surface by said one collecting surface thereby causing said second group of filaments to extend longitudinally along said fabric.

2. The apparatus of claim 1 wherein a deflector plate is positioned to spread the second group of filaments and deflect said filaments onto said impact surface.

3. The apparatus of claim 2 wherein the collecting surfaces are porous belts.

4. The apparatus of claim 3 wherein the element is a stationary plate.

5. The apparatus of claim 1 wherein one of the collecting surfaces is a perforated drum.

* * * * *